US005873415A

United States Patent [19]

Edwards

[11] Patent Number: 5,873,415

[45] Date of Patent: Feb. 23, 1999

[54] COMPLETION SUB-SEA TEST TREE

[75] Inventor: Jeffrey Charles Edwards, Aberdeen, Scotland

[73] Assignee: Expro North Sea Limited, United Kingdom

[21] Appl. No.: 765,983

[22] PCT Filed: May 10, 1996

[86] PCT No.: PCT/GB96/01115

§ 371 Date: Jan. 27, 1997

§ 102(e) Date: Jan. 27, 1997

[87] PCT Pub. No.: WO96/35857

PCT Pub. Date: Nov. 14, 1996

[30] Foreign Application Priority Data

May 11, 1995 [GB] United Kingdom ..... 9509547

[51] Int. Cl.[6] ..... E21B 33/00

[52] U.S. Cl. ..... 166/344; 166/368

[58] Field of Search ..... 166/344, 360, 166/361, 368, 351

[56] References Cited

U.S. PATENT DOCUMENTS

| | | | |
|---|---|---|---|
| Re. 28,588 | 10/1975 | Sizer et al. | 166/224 |
| 2,785,755 | 3/1957 | Dean | 166/72 |
| 3,481,395 | 12/1969 | Sizer et al. | 166/0.5 |
| 3,797,573 | 3/1974 | Crowe | 166/224 |
| 3,850,237 | 11/1974 | Ahlstone et al. | 166/0.5 |
| 3,865,191 | 2/1975 | Mott | 166/315 |
| 4,076,077 | 2/1978 | Nix et al. | 166/315 |
| 4,143,712 | 3/1979 | James et al. | 166/72 |
| 4,183,404 | 1/1980 | James et al. | 166/133 |
| 4,189,003 | 2/1980 | James et al. | 166/315 |
| 4,441,558 | 4/1984 | Welch et al. | 166/321 |
| 5,137,086 | 8/1992 | Stokley et al. | 166/264 |
| 5,372,199 | 12/1994 | Cegielski et al. | 166/368 |

*Primary Examiner*—William Neuder

*Attorney, Agent, or Firm*—Gifford, Krass, Groh, Sprinkle, Patmore, Anderson & Citkowski, P.C.

[57] ABSTRACT

A dual bore completion sub-sea test tree (10) is described which has main bore (18) and an auxiliary or annulus bore (20). Two identical ball valves (22, 24) are located in series within the main bore (18) and two smaller identical ball valves (26, 28) are located in series in the annulus bore (20). The ball valves (22, 24, 26, 28) are operated by respective independent control lines acting on the operating mechanisms of the respective valves within the test tree (10) to move the valves between open and closed positions to allow or deny communication through the respective bores (18, 20). The completion sub-sea test tree (10) provides isolation of the main bore (18) and/or the annulus bore (20) when required by application of hydraulic pressure to assist closure to spring forces sufficient to cut coil tubing in the event of an emergency situation requiring rapid disconnect. Hydraulic communications across the tree disconnect is achieved using independent hydraulic stabs which can selectively isolate or allow the hydraulic systems to vent when disconnected. A helical guide (82) and axial slot (81) are provided on the surface (16, 83) of the housing to engage with a pin (84) on a BOP stack to orientate the tree (10) correctly to a tubing hanger (86).

11 Claims, 7 Drawing Sheets

COMPLETION SUB-SEA TEST TREE

BACKGROUND OF THE INVENTION

1. Field of the Invention

The present invention relates to a completion sub-sea test tree particularly, but not exclusively, to provide tubing and annulus isolation in a production well and the invention also relates to a method of rapid disconnection when completing and testing sub-sea production wells.

2. Description of the Relevant Prior Art

The requirement to perform a well test on a sub-sea well before completion and tree installation is becoming increasingly common. At present, this is performed by running a test string, performing the test and then temporarily suspending the well prior to completion. This procedure has a major impact in three principal areas: it increases cost and rig time during running and retrieving the test string; it creates difficulties when retrieving the well in both terms of time and increased costs, and formation damage may be caused during the suspension and re-entry phases. These problems are particularly relevant with batched drill wells and those with EWT potential.

It is desirable to overcome these problems in such a way which allows a well test/clean up to be conducted through a completion via a conventional production tubing hanger to avoid the need to run and pull the test string and the running and pulling of the suspension system, and associated costs and problems.

An object of the present invention is to provide an apparatus which obviates or mitigates at least one of the aforementioned problems.

A further object of the invention is to provide apparatus which provides isolation of the tubing string and allows disconnection from the well in the event of a rig positioning problem.

A further object of the present invention is to provide isolation of the annulus from the main riser without the requirement to close any of the blow-out-preventer (BOP) rams.

A further object of the invention is to provide the ability to orientate the completion sub-sea test tree, and consequently the attached tubing hanger and completion, into a desired position required to receive the production tree and subsequent tie-backs when deployed.

SUMMARY OF THE INVENTION

This is achieved by providing a completion sub-sea test tree which defines a main bore, an auxiliary or annulus bore and an independently operated valve in the main bore and a further valve in the annulus bore which, in turn, are operated by respective independent control lines acting on the operating mechanism of the respective valves within the test tree. The completion sub-sea test tree provides isolation of the main and/or annulus bore when required. In a preferred arrangement the valves in the main bore and annulus are ball valves and isolation is achieved by metal-to-metal seals between the ball valves and valves seats.

Application of hydraulic pressure provides assist closure to the spring force to cut coil tubing and enabling the valves to be forced closed in the event of an emergency situation requiring rapid disconnect. Hydraulic communication across the tree disconnect is achieved using independent hydraulic stabs which can selectively isolate or allow the hydraulic systems to vent when disconnected. This has the advantage of ensuring that the tubing hanger hydraulic systems are not sensitive to volume changes generated by thermal or pressure effects.

Correct orientation of the tree and tubing hanger assembly is achieved by an orientation slot on the outside diameter of the tree which engages with a pin deployed from the BOP stack.

The independent valves are normally held closed by spring force. Hydraulic pressure applied to the upper face of the operating piston will overcome the spring force to open the valves.

Unlatching from the completion sub-sea test tree is achieved by pressurising a latch control line which overcomes the forces generated by the latch spring lifting the piston allowing the latch body and orientation sleeve to be retrieved. A further safety feature is the sensitivity of the latch piston to valve opening control lines and this ensures the latch piston can only operate once both valves are fully closed and the well isolated.

A chemical injection facility is included in the completion tree and allow injection of chemicals, such as hydrate suppressants, anti-foams and corrosion inhibitors. The injection point is located between the valves allowing fluids to be displaced into the completion bore via the pump-through capability of the lower ball valve. The injection point is protected by dual independent check valves located in the valve body and further protection is also provided by the hydraulic stab which isolates the system after disconnection.

In the event of valve failure the well can be killed by displacing reservoir fluids via the pump through capability of the valves into the main bore. The maximum displacement pressure requires to fully open the valves at 75 p.s.i.g. Upon loss of differential pressure the valves automatically reseat, thereby isolating the reservoir.

The present design is different from a conventional sub-sea test tree because annulus isolation is achieved by the integral valves as opposed to closing the BOP rams on a slick joint as with a conventional design. This allows the completion tree to be situated lower in the BOP stack and avoids increased length of the valve assembly comprising the integrity of the operation by placing the latch and possibly the valve section across the shear rams and therefore negating this unacceptable risk.

The upper valve also has the ability to support a pressure differential from above which allows string integrity etc. to be tested prior to opening the valves or upon re-latch following disconnection.

According to a first aspect of the present invention there is provided a completion sub-sea test tree comprising a tree housing, said tree housing defining a main bore extending from one end of the tree to the other end of the tree, an auxiliary or annulus bore of smaller diameter than the main bore extending from said one end to said other end, said main bore and said auxiliary or annulus bore being parallel within said tree housing, at least one large valve being disposed in said main bore and at least one small valve being disposed in said annulus bore, each of said large and small valves being independently operable to move between an open and a closed position whereby, when said valves are in the open position there is communication through the main bore of the test tree and through the annulus bore of the test tree and when said valves are in a closed position there is no communication through said main bore or through said annulus bore.

Preferably there are two larger valves in said main bore and two smaller valves in said annulus bore, the larger valves and the smaller valves being spaced in series along the length of the bores. Conveniently, said larger and said smaller valves are ball valves. Alternatively, said valves may be roller valves or flap valves.

Preferably each of said valves in said main and said auxiliary bores have spring means disposed in said housing and coupled to a moveable valve element of a respective valve for urging said valves to a closed position. Conveniently, said ball valves are apertured ball valves which are moveable rotationally and axially within said main bore and said annulus bore upon the application of hydraulic pressure so that the valves move between the open and closed positions.

According to another aspect of the present invention there is provided a method of providing tubing and annulus isolation in a production well comprising the steps of, providing a completion test tree having a main bore and a parallel annulus bore, disposing at least one operable valve element in said main bore and at least one operable valve element in said annulus bore, said main bore and said annulus bore being disposed in the same housing, and operating said valves in said main bore and in said annulus bore to move between an open and a closed position as required in order to isolate the well or to provide communication through said completion tree.

BRIEF DESCRIPTION OF THE DRAWINGS

These and other aspects of the invention will become apparent from the following description when taken in combination with the accompanying drawings in which.

DETAILED DESCRIPTION OF THE INVENTION

Figure 1:
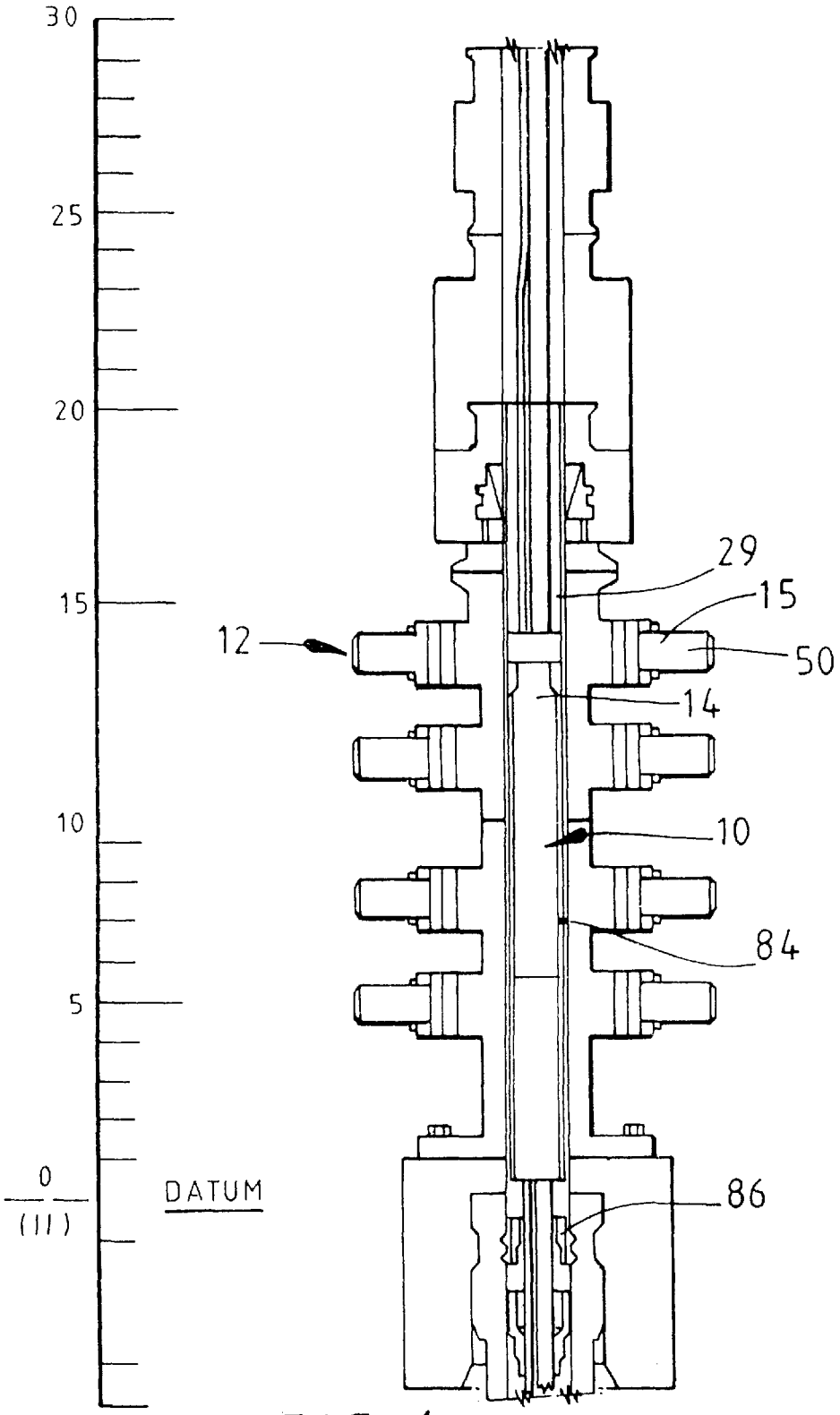
FIG. 1 depicts a completion tree in accordance with an embodiment of the present invention located in the BOP stack beneath the shear rams.

Reference is now made to the 5"×2" completion tree 10 shown in FIG. 1 of the drawings. It will be appreciated that the completion tree 10 is dimensioned and proportioned so that when a completion or well intervention is run the completion sub-sea tree fits within a BOP stack 12 so that the top 14 of the 5"×2" completion tree 10 is beneath the shear rams 15.

Figure 2:
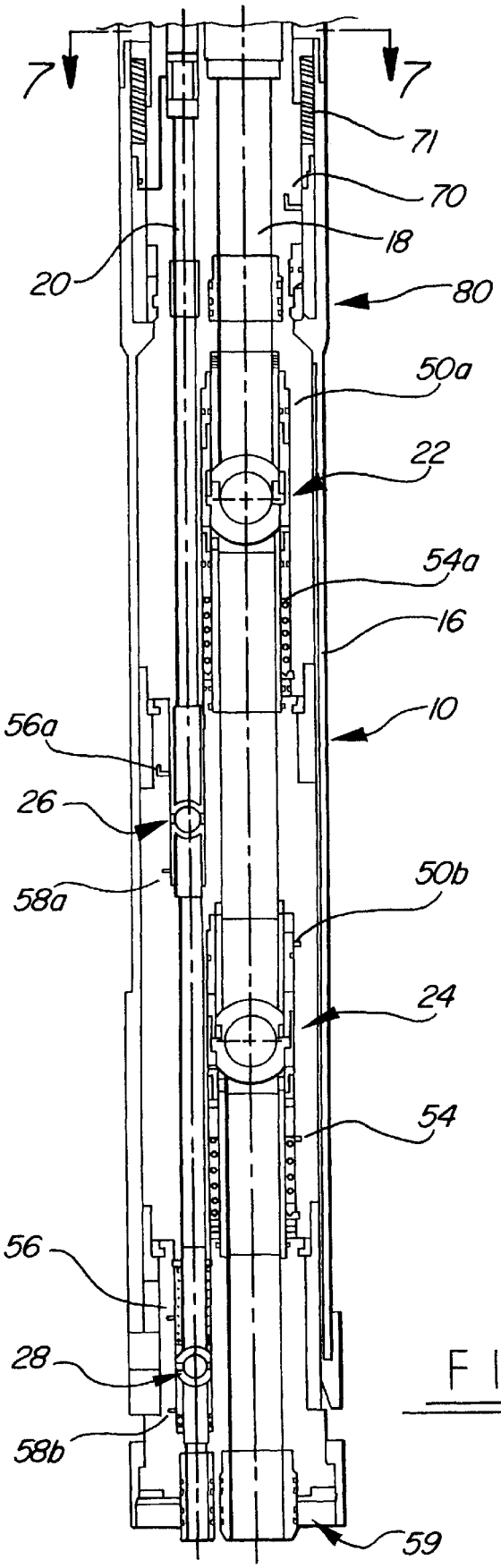
FIG. 2 is an enlarged longitudinal sectional view of the completion tree shown in FIG. 1.

Referring now to FIG. 2 of the drawings, the 5"×2" completion tree 10 has an upper latch section generally indicated by reference numeral 16 which may be coupled to drill string (not shown) to raise and lower the completion tree 10 into the BOP stack 12 or production wellhead.

The completion tree 10 contains a main 5" bore generally indicated by reference numeral 18 and an auxiliary annulus 2" bore 20. Two identical ball valves 22 and 24 are located in series within the main bore 18. These ball valves are of the type disclosed in applicant's co-pending published PCT Application WO 93/03255. Similarly, two smaller ball valves 26 and 28, which are the same type as valves 22,24, are located, in series, in the annulus bore 20.

Figure 3:
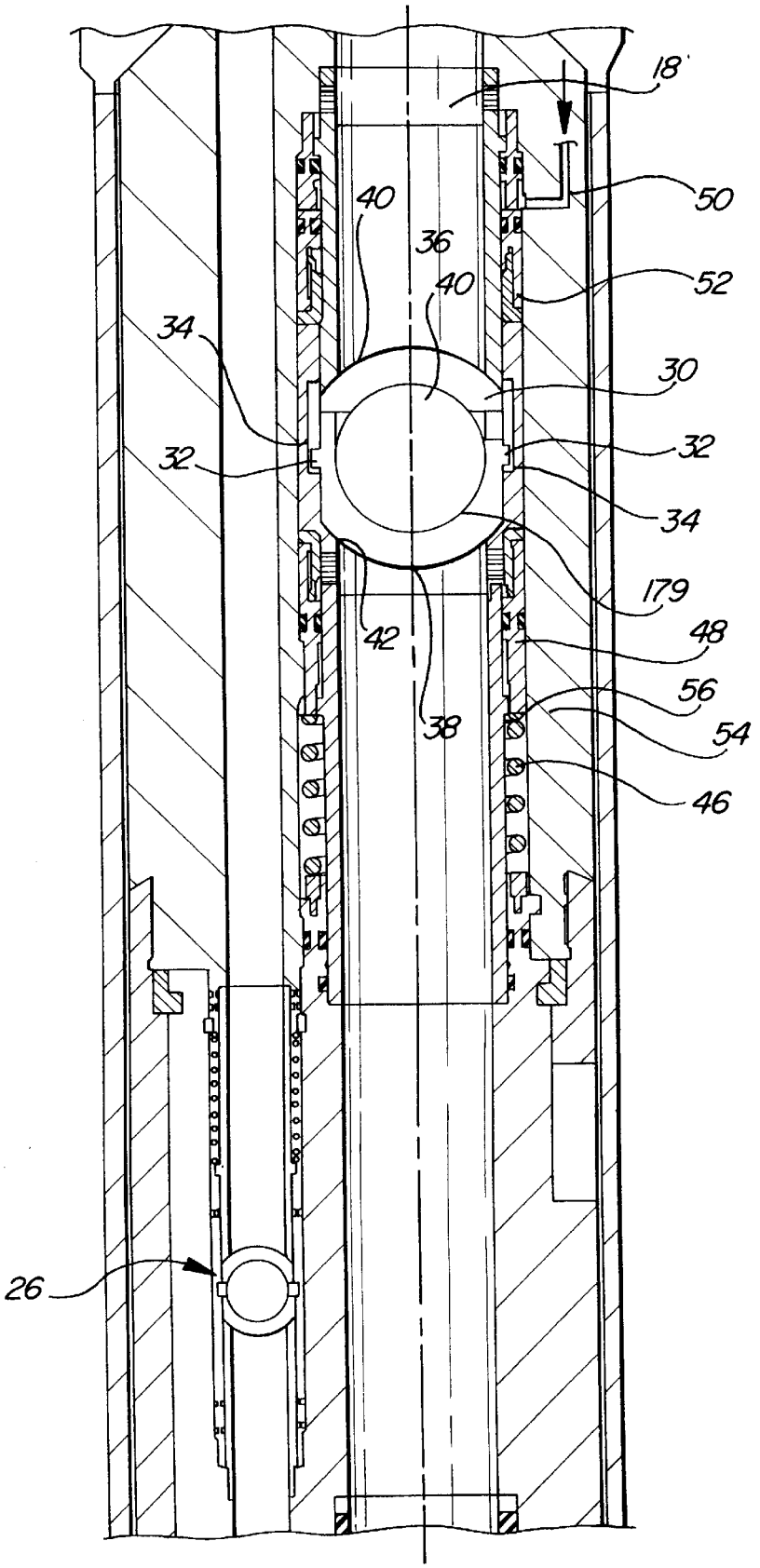
FIG. 3 is an enlarged view of part of the completion tree shown in FIG. 2 depicting the ball valve in the main bore and a ball valve in the annulus bore in more detail.

Reference is now made to FIG. 3 of the drawings which depicts an enlarged view of part of the completion tree shown in FIG. 2. In this case it will be seen that the ball valve 22 consists of a ball element 30 which has spigots 32 journaled in ball trunnions 34 which are, in fact, slots. As shown, the ball has upper and lower spherical surfaces 36 and 38 and which are shown engaged against respective upper and lower valve seals 40 and 42. The ball element 30 has a through aperture 44 which is of the same diameter as the bore 18.

In the position shown in FIG. 3 the valve is in the closed position. This is because a lower coil spring 46 acts on an annular piston 48 which in turn acts on a ball cage assembly to force the ball to be rotated and moved axially to the position shown. In order to open the valve hydraulic pressure is applied via hydraulic line 50*a* above the valve 22 which acts on annular piston 52, which forces the piston 52 downward against the force of spring 46 and, as the spigots 34 move down, the oblique slots 34, as described in published co-pending application WO 93/03255, the ball valve element is rotated through 90° so that the aperture 44 is aligned with the bore 18 and thus the valve is opened. In order to close the valve hydraulic pressure is applied via line 54*a* which has an outlet 55 between the annular piston 48 and spring 46 and this provides a force against the piston 48 to assist the force of the spring 46 in moving the piston upwards and thus rotating the valve from the open position to the closed position as shown.

Figure 4:
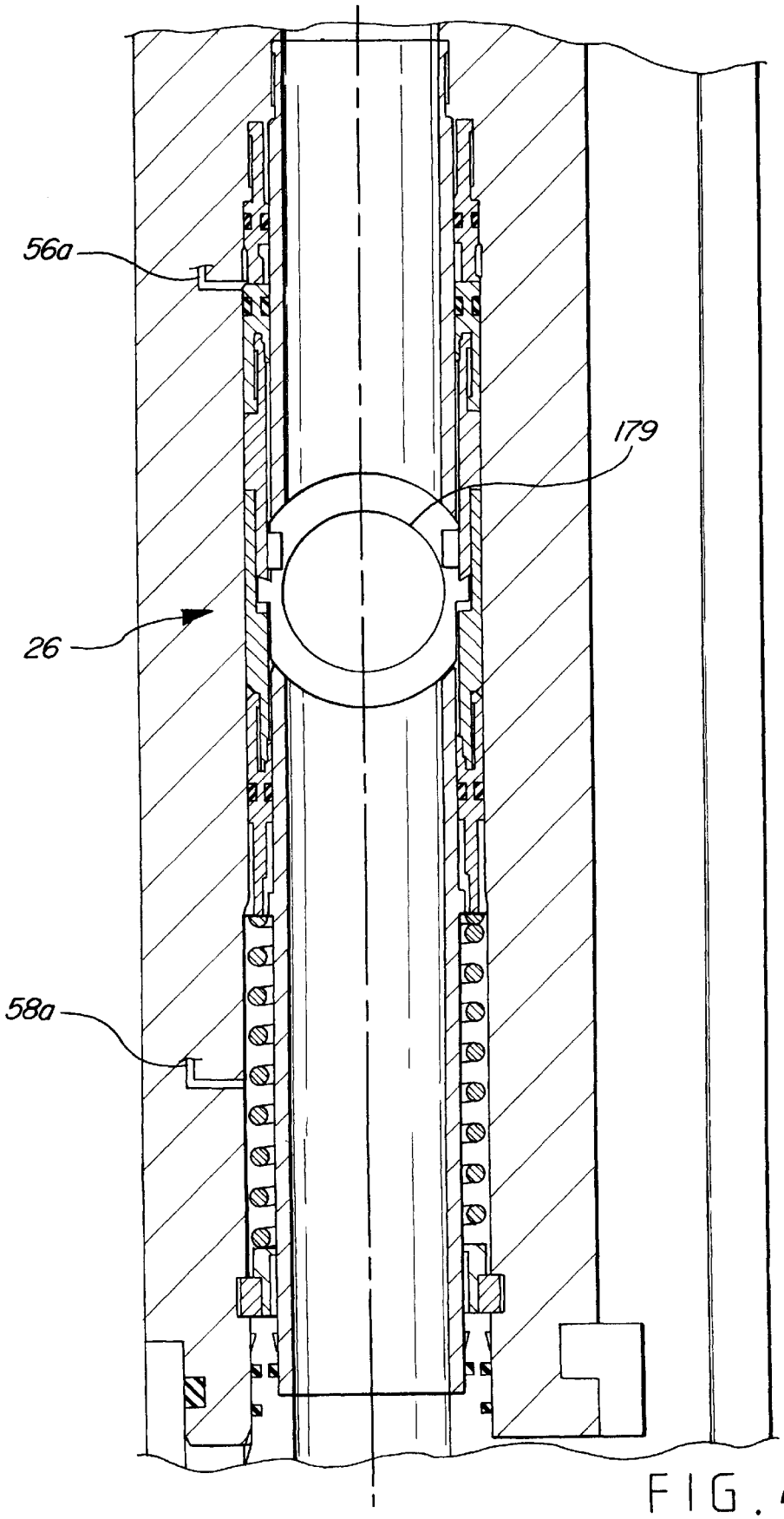
FIG. 4 is a view similar to FIG. 3 but showing the ball valve with the spring in an extended position.

It will be appreciated that the other valves 24,26,28 are configured to operate in the same way. Reference is now made to FIG. 4 of the drawings which depicts an enlarged view of annulus valve 26 which for a comparison with valve 22 is substantially identical. In this case, the hydraulic line 56*a* for opening the valve is disposed at the upper left side of the drawing and the hydraulic line 58*a* assisting the spring force enclosing the valve is shown at the lower left side. In the drawings shown the valve is actuated to be in the closed position.

Referring back to FIGS. 1 and 2 of the drawings, it will be seen that the bottom of the sub-sea test tree 10 has a latch 59 which is configured to lock on the tubing hanger 60 which is located in the wellhead 62.

In operation all four valves 22,24,26,28 are normally closed. Hydraulic pressure is applied via the respective hydraulic lines 50*a,b* to open the valve 22 and then valve 24 so that the well can be flowed and an intervention core tubing wireline (not shown) can be passed through the open valves 22,24.

Then annulus valves 26,28 are opened in series via hydraulic pressure in lines 56*a,b* to control the annulus pressure and allow the passage of wireline equipment.

Figure 5:
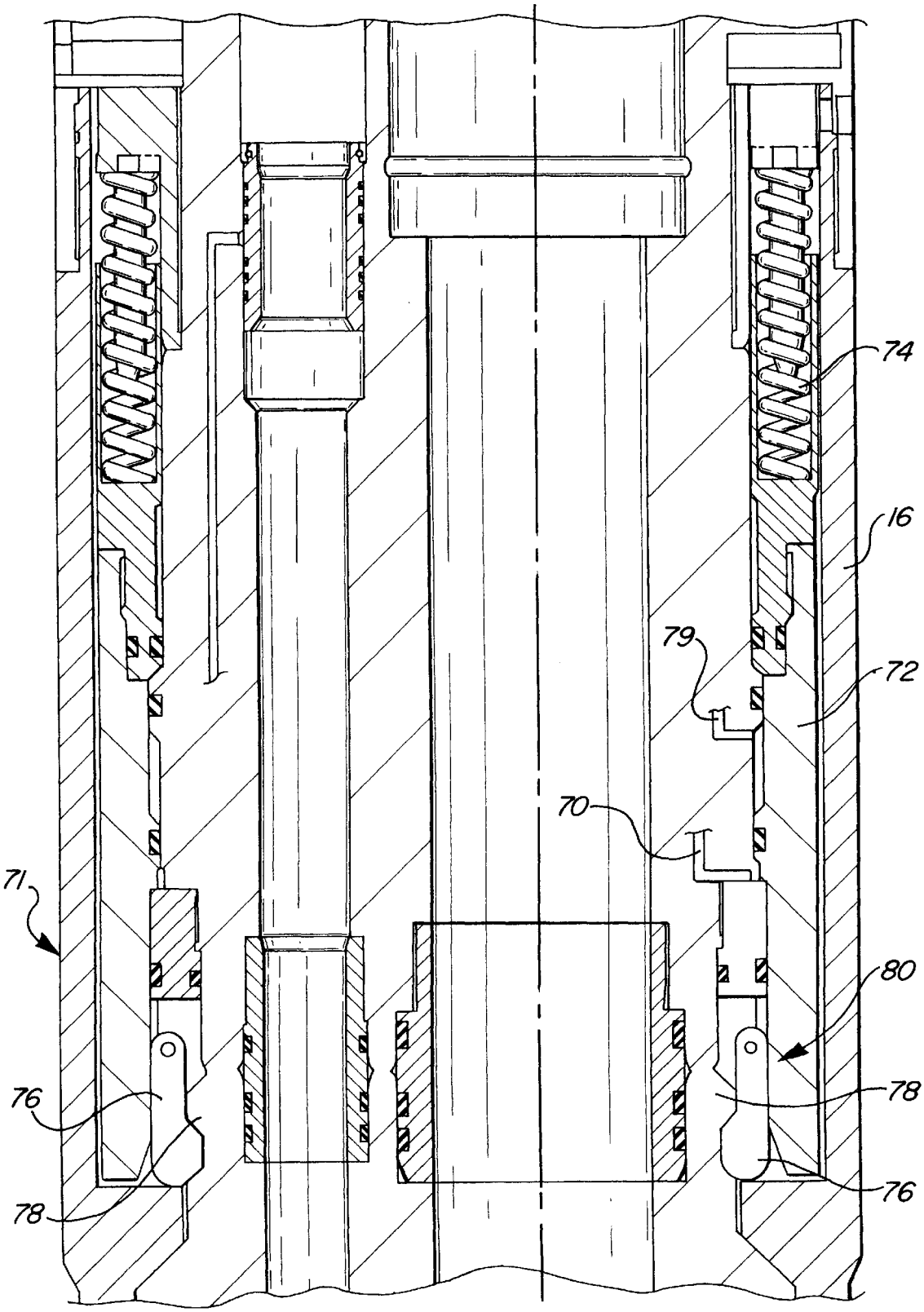
FIG. 5 is an enlarged view of part of the completion tree showing the latching arrangement of the completion tree sleeve to the valve section.

If problems arise, for example the presence of water, then the control lines 54*a,b* and 56*a,b* to the respective valves 22,24,26,28 can be bled thereby allowing the force of the valve springs to actuate the respective annulus pistons to close the valves, as was previously described with reference to valve 22. The system is then pressured up and a further control line 70 in the top of tree 10, as shown in FIG. 5, is used to provide hydraulic pressure to allow the sleeve 16 to be unlatched and be withdrawn from the tree 10. Unlatching of the sleeve 16 is achieved by the pressure acting on piston 72 against the force of spring 74 to pivot latches 76 out of engagement with a mating annular latch ring 78 thereby allowing the sleeve 16 to be withdrawn. Pressure applied via hydraulic line 79 forces piston 72 down and keeps the latches 76 locked to the ring 78.

It will be appreciated that in order to provide maximum flexibility the design is based on the industry standard of interface of 5.375 and 1.875 offsets, thereby allowing use with all major tubing hanger systems. The standard 5"×2" completion tree 10 consists of a modular unit which consists of a latch module 80 which provides the primary disconnect function and allows the sleeve 16 (FIG. 1) to be disconnected from the valve section 10 in the event of loss of rig positioning or severe weather, the tubing isolation module where each isolation module includes a 5" failsafe ball valve which can be closed to isolate the landing string from the well. Each 5" ball valve has a shaped and hardened edge 79 (FIGS. 3,4) which is capable of cutting 2" core or coiled tubing and obtaining a bubble type gas seal after cutting. The upper module provides the interface to a latch section and lock system for the orientation sleeve; an annular isolation module which includes the two annulus isolation valves also provides a crossover network which allows the system to interface to alternative manufacturers tubing hangers running tools, and an outer orientation sleeve which effectively forms the outer house for the assembly. The outside diameter is identical to the tubing hanger vendors orientation system which has the significant advantage of allowing the tree to be oriented to the tubing hanger and also provides rotational guidance during relatching.

Figure 6A:
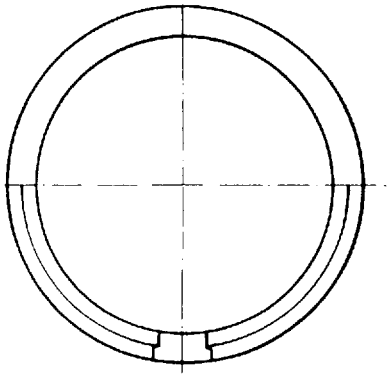
FIG. 6*a* shows the top view of the detail of the orientation slot on a completion tree for correctly orienting the tree on to the tubing hanger.
Figure 6B:
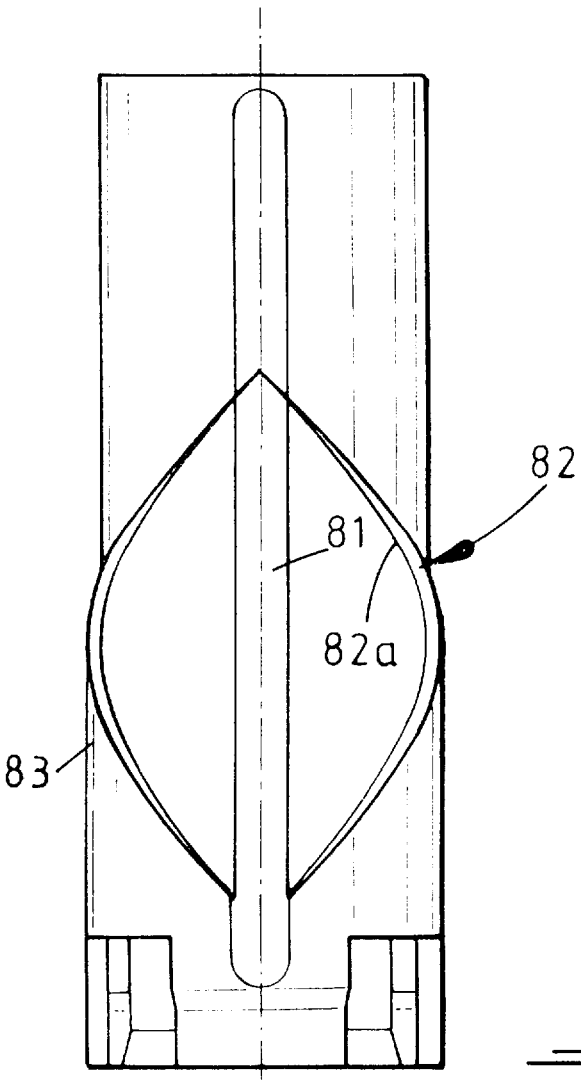
FIG. 6*b* shows a side view of the detail of the orientation slot on a completion tree for correctly orienting the tree on to the tubing hanger.

In this regard reference is made to FIGS. 6*a* and 6*b* of the drawings which respectively depict a top and side view of the outer sleeve 16 including an orientation slot 81 and a helical guide 82 formed by the edge 82*a* of an outer housing sleeve 83. The helical guide 82, when in the BOP stack 12, is engaged by a pin 84 (FIG. 1) and once it is engaged with the guide 82, the pin 84 rotates the tool 10 until the pin 84 engages with the slot 81 so that the system is correctly oriented to the appropriate tubing hanger 86.

Figure 7:
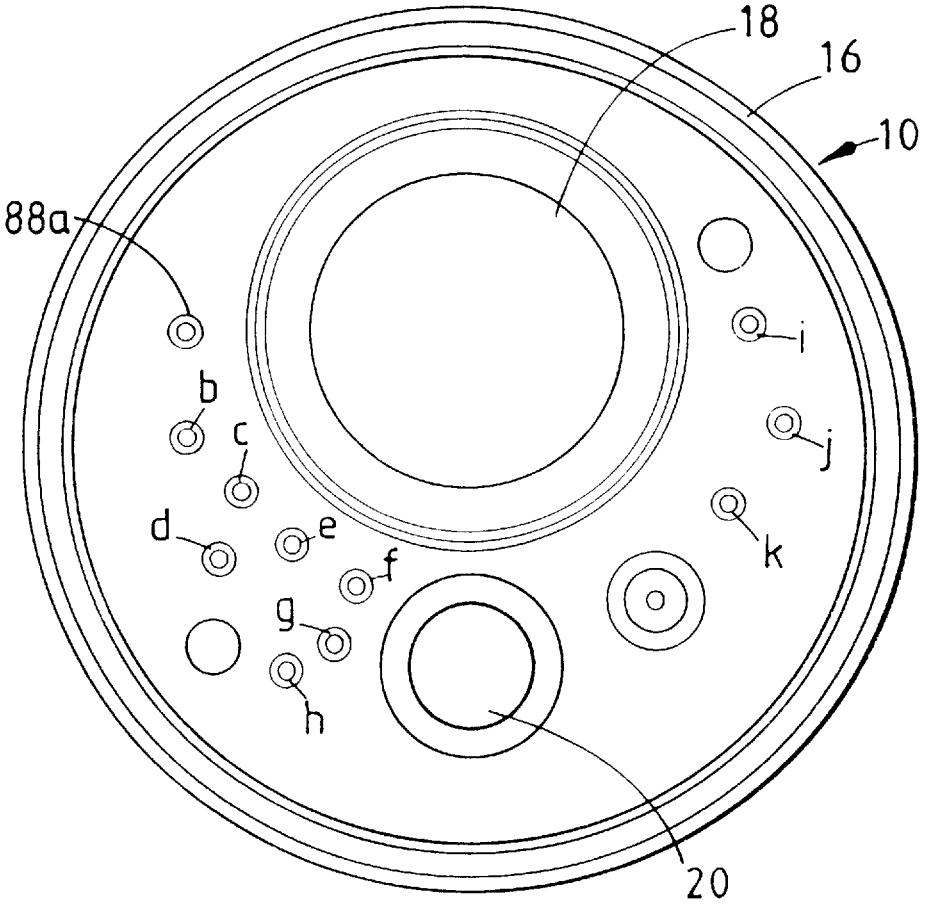
FIG. 7 is a top end view of the completion tree showing the main bore and annulus bore and the hydraulic ports for actuating the main bore valves and annulus bore valses.

Reference is now made to FIG. 7 of the drawings which is a top view of the completion sub-sea test tree 10 shown in FIG. 2 of the drawings. It will be seen that the tree is circular in cross-section and the main bore 18 is offset from the centre as is the annular bore 20. The section shows a plurality of ports 88*a* to 88*k* for receiving a plurality of stab elements coupled to a top sub (not shown) so that when the top sub is coupled to the completion tree the hydraulic lines are connected via ports 88*a* to 88*k* to provide hydraulic connections to four valve elements and to the latching element.

It will be appreciated that various modifications may be made to the apparatus hereinbefore described without departing from the scope of the invention. For example, although the completion tree is shown with two ball valves in the main bore and two ball valves in the annular bore, it will be appreciated that it would be possible to have a single valve in the main bore and a single valve in the annulus bore. In addition, it will also be appreciated that some or all of the ball valves may be replaced by other types of valves such as flap valves, roller valves and the like. Different valve-type combinations may also be used. In addition, the springs may be omitted and each respective valve actuated by hydraulic means to open and close.

I claim:

1. A completion sub-sea test tree comprising a tree housing, said tree housing having two opposed ends defining a main bore extending from one end of the tree to the other end of the tree, an auxiliary bore of smaller diameter than the main bore extending from said one end to said other end, said main bore and said auxiliary bore being parallel within said tree housing, at least one large valve being disposed in said main bore and at least one small valve being disposed in said auxiliary bore, each of said large and small valves being independently operable to move between an open and a closed position whereby, when said valves are in the open position there is communication through the main bore of the test tree and through the auxiliary bore of the test tree and when said valves are in a closed position there is no communication through said main bore or through said auxiliary bore.

2. A test tree as claimed in claim 1 wherein there are two larger valves in said main bore and two smaller valves in said auxiliary bore, the larger valves and the smaller valves being spaced in series along the length of their respective bores.

3. A test tree as claimed in claim 2 wherein said larger and smaller valves are ball valves.

4. A test tree as claimed in claim 2 wherein said larger and smaller valves are roller valves.

5. A test tree as claimed in claim 2 wherein said larger and smaller valves are flap valves.

6. A test tree as claimed in claim 1 wherein each of said valves in said main and said auxiliary bores have spring means disposed in the housing and coupled to a moveable valve element of a respective valve for urging said moveable valve elements to a closed position.

7. A test tree as claimed in claim 3 wherein said ball valves are apertured ball valves which are moveable rotationally and axially within said main bore and said auxiliary bore upon the application of hydraulic pressure so that the valves move between the open and closed positions.

8. A test tree as claimed in claim 1 wherein an outer surface of the tree housing includes an axial orientation slot and a pin guide, said pin guide engaging, in use, with a pin in a BOP stack, and for rotating the tool to a position where the pin engages with said orientation slot thereby ensuring that the tree is correctly oriented when in use.

9. A test tree as claimed in claim 8 wherein said pin guide is a helical guide provided on the surface of the housing, said helical guide being formed by a face of the outer housing surface disposed above an inner housing surface.

10. A test tree as claimed in claim 3 wherein said larger ball valves have a ball element with a shaped and hardened edge which is capable of cutting 2" coiled tubing, in the case of at least a 5" ball valve element, and obtaining a bubble-type gas seal after cutting said coiled tubing.

11. A method of providing tubing and annulus isolation in a production well comprising the steps of, providing a completion test tree having a housing including a main bore and a parallel annulus bore disposed therein, disposing at least one operable valve element in said main bore and at least one operable valve element in said annulus bore, and operating said valves in said main bore and in said annulus bore to move between an open and a closed position as required in order to isolate the well or to provide communication through said completion tree.

* * * * *